United States Patent [19]

Ketchpel

[11] Patent Number: 4,670,690

[45] Date of Patent: Jun. 2, 1987

[54] THIN FILM ELECTROLUMENESCENT DISPLAY PANEL

[75] Inventor: Richard D. Ketchpel, Carpinteria, Calif.

[73] Assignee: Rockwell International Corporation, El Segundo, Calif.

[21] Appl. No.: 790,690

[22] Filed: Oct. 23, 1985

[51] Int. Cl.[4] ..... H05B 33/22; H05B 33/26

[52] U.S. Cl. ..... 313/505; 313/509

[58] Field of Search ..... 313/498, 505, 506, 509, 313/500

[56] References Cited

U.S. PATENT DOCUMENTS

| | | | |
|---|---|---|---|
| 3,184,635 | 5/1965 | O'Connell, Jr. | 313/506 X |
| 4,279,690 | 7/1981 | Dierschke | 313/498 X |
| 4,342,945 | 8/1982 | Ketchpel | 313/505 |

FOREIGN PATENT DOCUMENTS

| | | | |
|---|---|---|---|
| 181668 | 11/1962 | Sweden | 313/506 |

*Primary Examiner*—David K. Moore

*Assistant Examiner*—K. Wieder

*Attorney, Agent, or Firm*—H. Fredrick Hamann; Craig O. Malin

[57] ABSTRACT

An electroluminescent (EL) material is sandwiched between parallel strips of electrodes running at right angles to each other. Pixels are formed where the electrodes cross to provide a thin film, EL display. The display includes a layer of insulating material which has a hole at each pixel. The backside electrodes extend into the holes, thus providing a high electric field only at the pixel locations. These backside electrodes are broad to assure electrical continuity despite any open-circuit created by burned-out pixels. The insulating material overlaps the edges of the frontside electrodes, thus reducing the electric field which concentrates at the electrode edge. The insulating layer and the backside electrode can be made black, or a light-absorbing, semi-insulating layer used in order to reduce light scattering and reflection. Transparent electrodes can be used to allow light to emit from either the front, the back, or both sides of the display.

28 Claims, 16 Drawing Figures

Fig.5a.
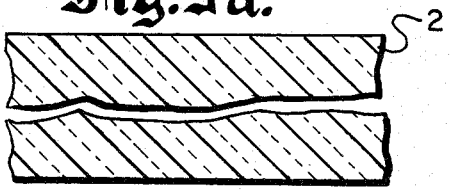
Fig.5b.
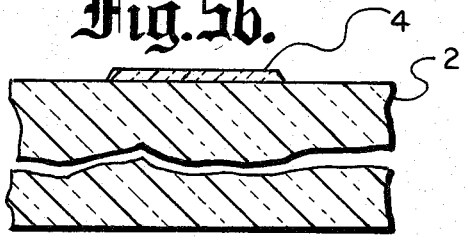
Fig.5c.
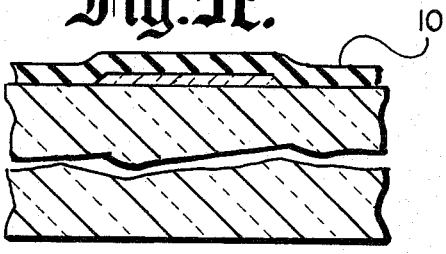
Fig.5d.
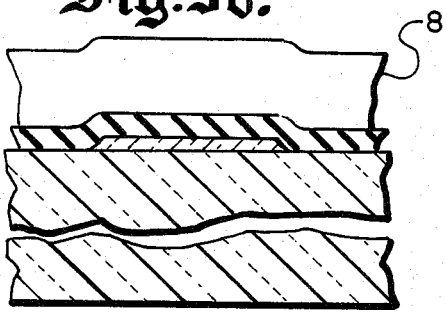
Fig.5e.
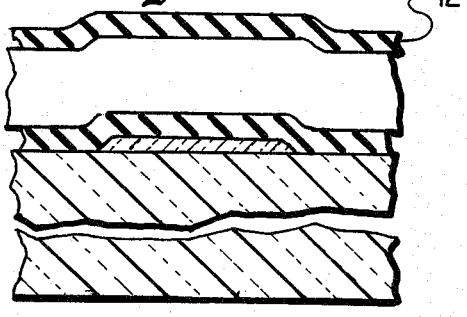
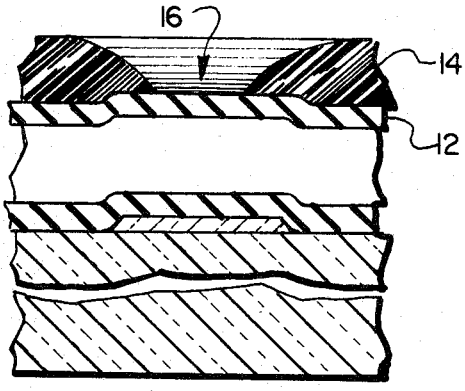
Fig.5f.
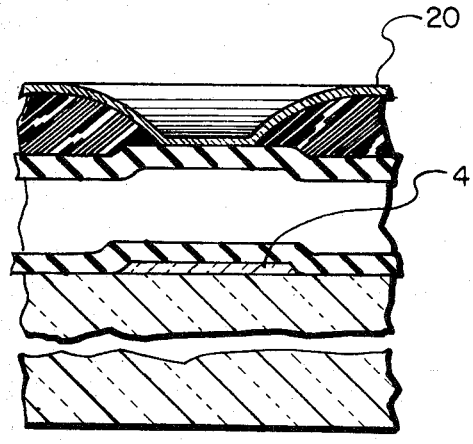
Fig.5g.
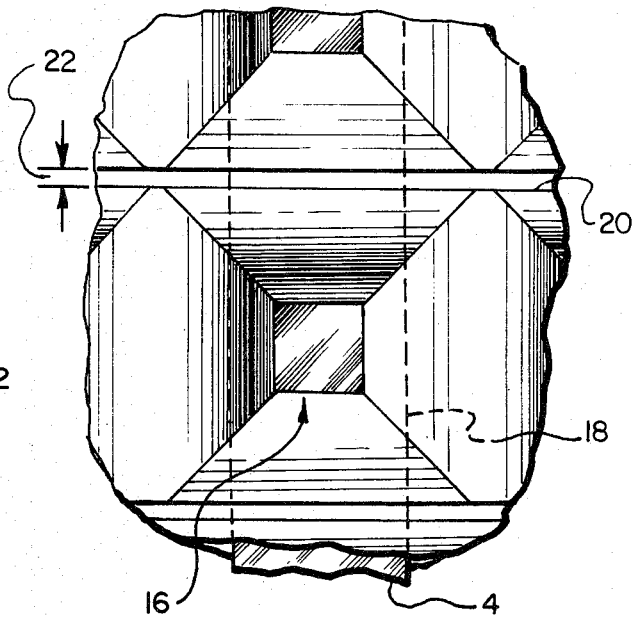
Fig.4.

THIN FILM ELECTROLUMENESCENT DISPLAY PANEL

BACKGROUND OF THE INVENTION

This invention relates to display devices and particularly to thin film, electroluminescent (TFEL) display devices.

Light emitting display devices have been fabricated utilizing the electroluminescent effect obtained by exposing special light-emitting materials (sometimes called phosphors) to an electrical field. In order to provide high contrast in TFEL displays, it is known to provide a light absorbing (black) dielectric layer between the active layer of electroluminescent material and the back electrode as described in U.S. Pat. No. 3,560,784 to G. N. Steele, et al. It is also known to provide such a black background behind a transparent backside electrode and to make electrical connection to the transparent backside electrode through openings or border areas in the black background (U.S. Pat. No. 4,488,084 to S. G. Linfors, et al).

In addition to having high contrast, it is important for a TFEL display to have a long life. Unfortunately the high electric fields required to provide electroluminescense can cause sporadic breakdowns of the EL film in some locations, and these breakdowns can in turn produce a break in the continuity of the overlying electrode at such locations. To reduce these breakdowns, it is known to provide strips of insulating material under one side of each of the parallel strips of metal, thus reducing the electrical field in a "bus rail" portion of the backside electrodes (U.S. Pat. No. 4,342,945 to the present inventor, Richard D. Ketchpel).

These prior art techniques have helped increase the contrast and the life of TFEL displays. However, there is a continuing need to provide TFEL display structures which can be economically fabricated to provide high contrast, long life, and reliable quality.

SUMMARY OF THE INVENTION

It is an object of the invention to provide TFEL displays with high contrast.

It is an object of the invention to provide TFEL displays with increased lifetimes.

It is an object of the invention to provide reliable TFEL displays which are not susceptible to propagating modes of failure.

It is an object of the invention to provide TFEL displays having both high contrast and increased lifetimes.

According to the invention, an EL material is sandwiched between parallel strips of electrodes, running at right angles to each other. The electrodes form pixels between them in the EL material at locations where they cross over each other.

The backside (the side opposite the substrate, generally the non-viewing side) of the EL layer is covered with a layer of insulating material which has holes through it at each pixel. Broad parallel strips of backside electrodes are formed on this insulating material so that they extend into the holes and therefore into contact with the EL layer at each pixel. However, the backside electrodes are spaced away from the EL layer by the insulating material outside the hole in the areas between the pixels. This provides a higher electric field where needed in the light-emitting pixel location (the holes) but lower electric fields outside the pixel (between the holes) to prevent breakdown of the EL layer.

The insulating layer overlaps the edge formed by the frontside electrode to reduce the electric field which tends to concentrate at the electrode edge, further helping to prevent breakdown of the EL layer.

In a second embodiment, the insulating layer is black to absorb light and thus reduce light scattering.

In a third embodiment, the backside electrode is black, to absorb light and thus reduce light scattering.

In a fourth embodiment, the EL layer has a black semi-insulating layer covering it over the dielectric layer and under the backside electrode to reduce light scattering and reflection.

In a fifth embodiment, the insulating layer with the pixel holes is deposited on the substrate and partly over the frontside electrode rather than on the backside.

In a sixth embodiment, the backside electrode is made transparent so that light can shine from the backside of the display panel.

These and other objects and features of the invention will be apparent from the following detailed description taken with reference to the accompanying drawings.

DRAWINGS

FIG. 4 is a top view (backside) of a TFEL pixel;

Figure 1:
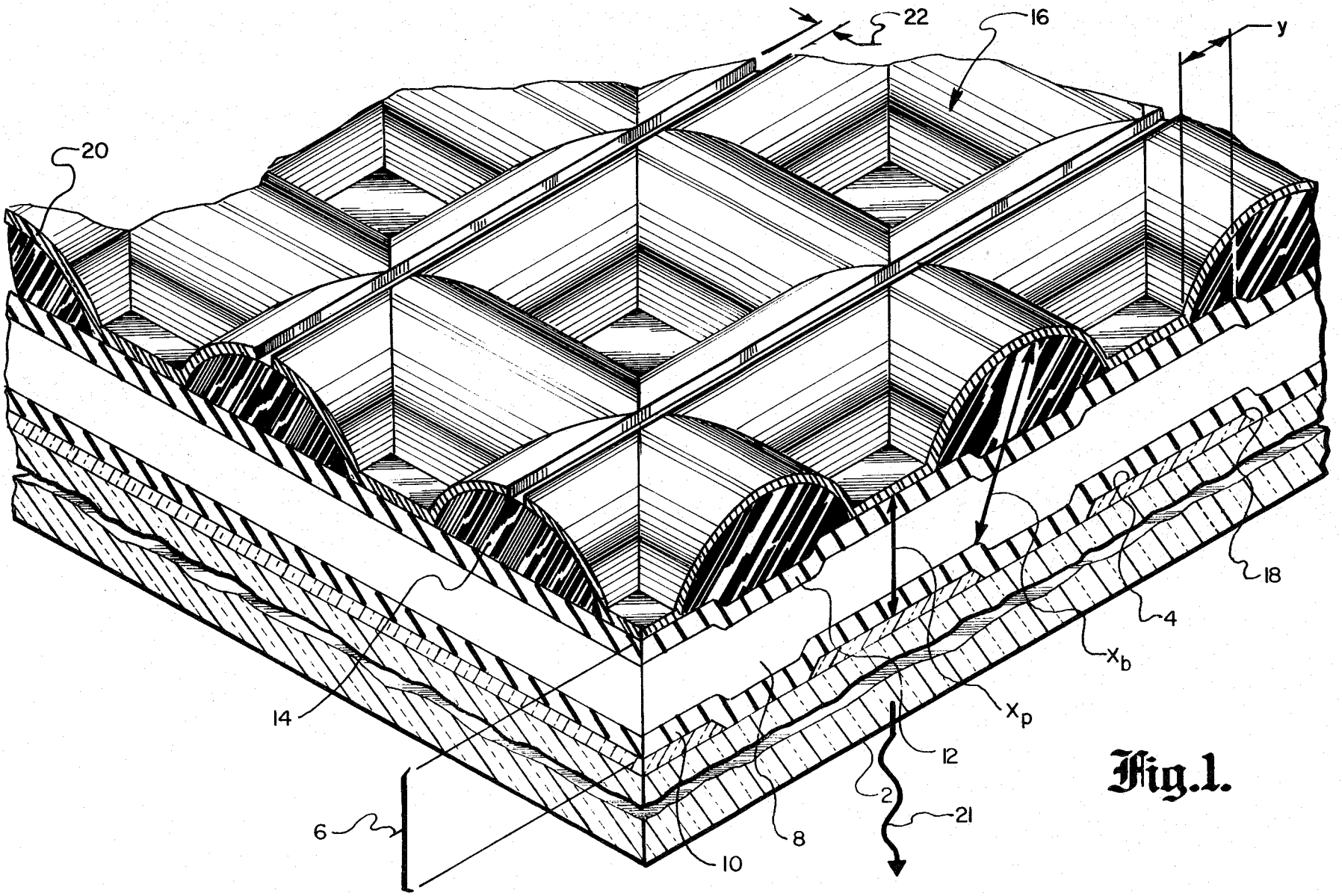
FIG. 1 is a perspective, cross-sectional view of a thin film electroluminescent (TFEL) display panel according to a first embodiment of the invention.
Figure 2:
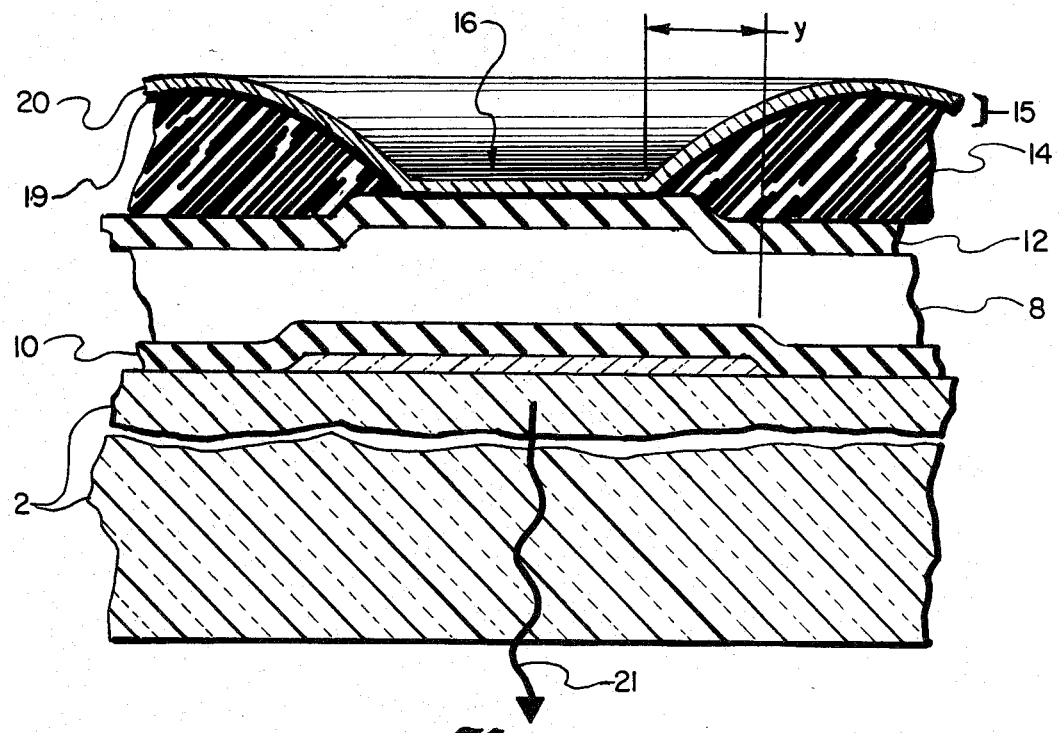
FIG. 2 is a cross-section showing in detail a pixel of a TFEL display according to a second embodiment of the invention.
Figure 3:
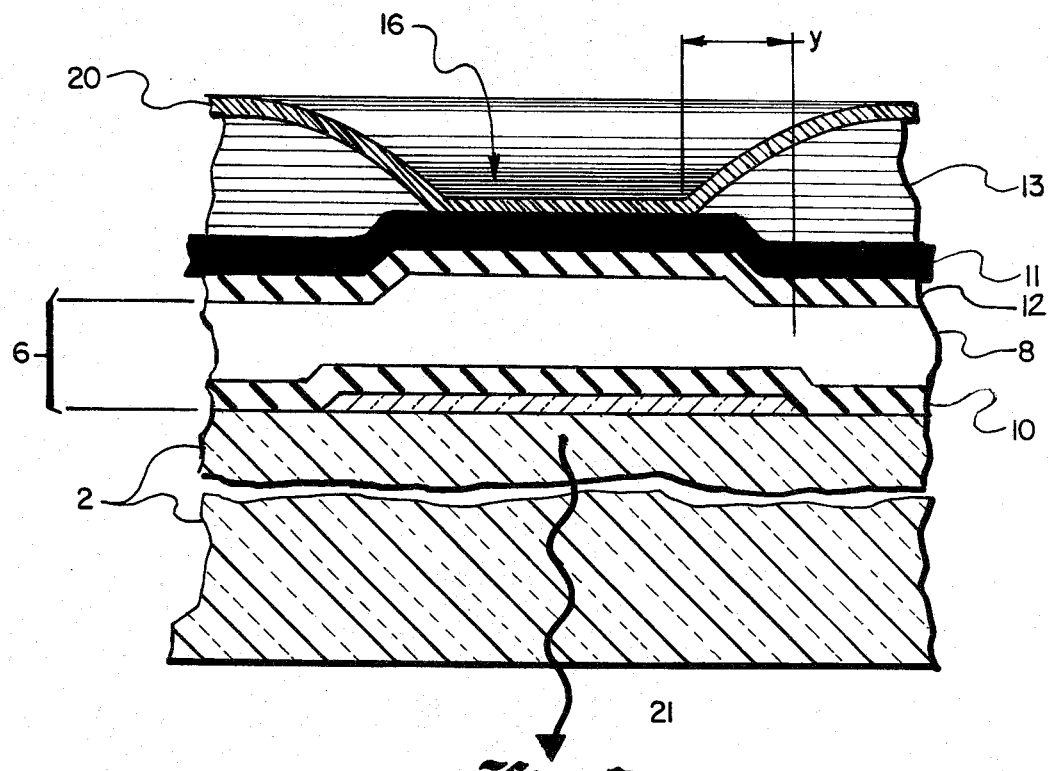
FIG. 3 is a cross-section showing in detail a pixel of a TFEL display according to a third embodiment of the invention.
Figure 6:
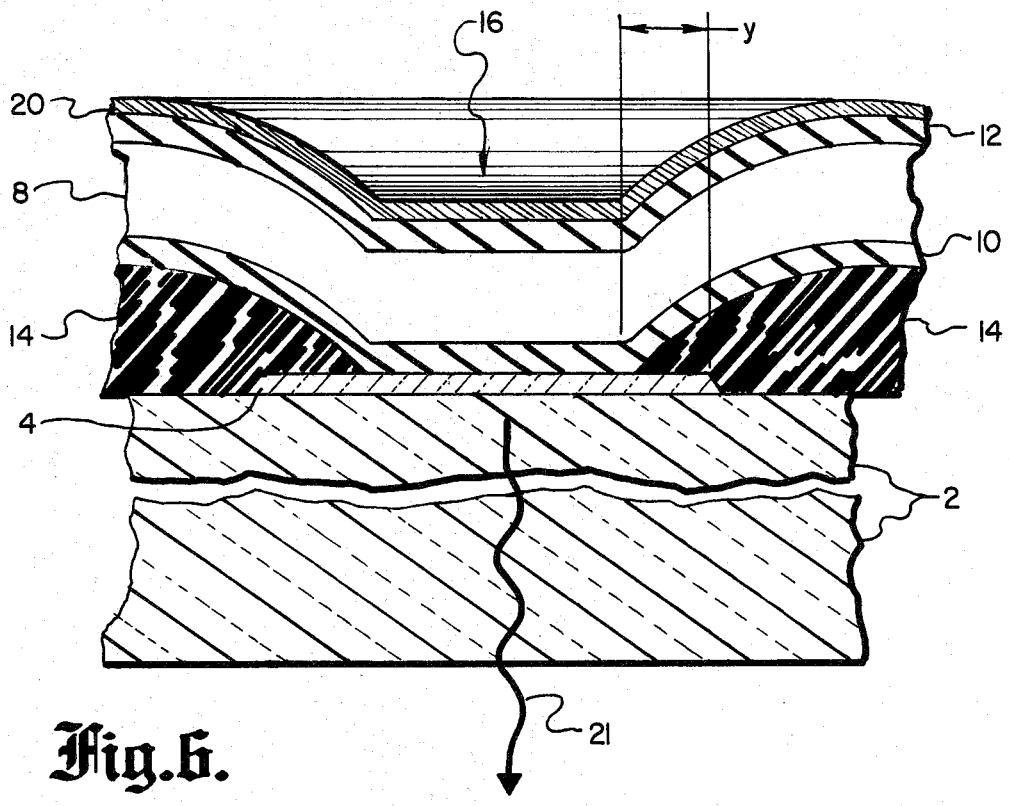
Figure 7:
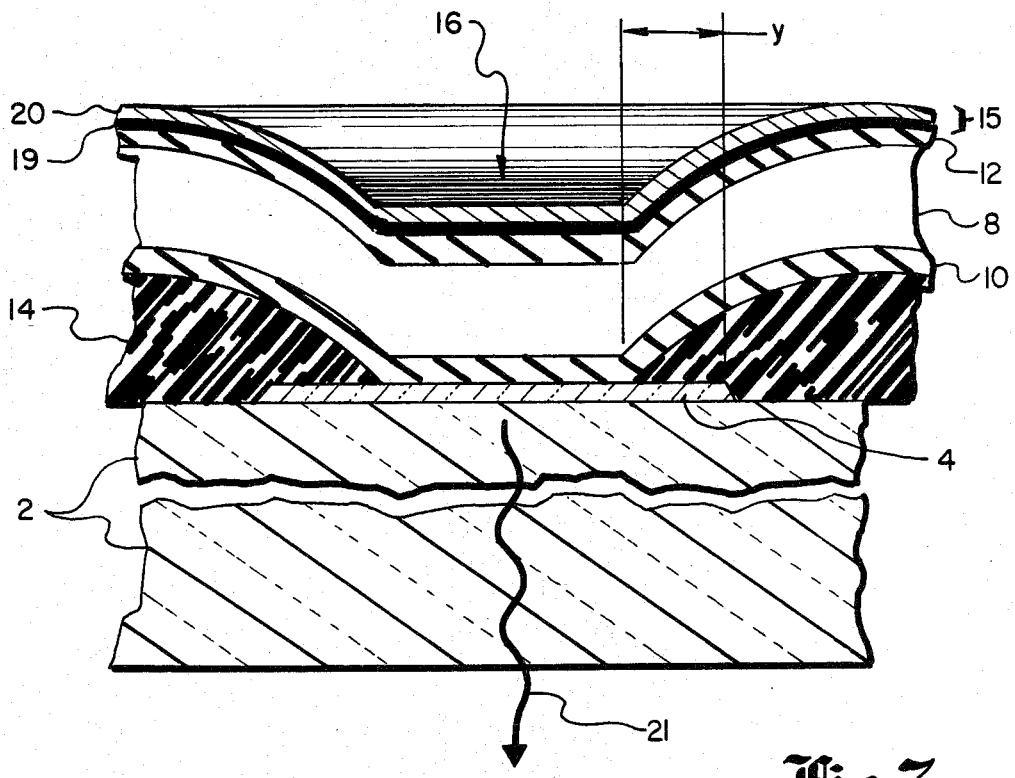
Figure 8:
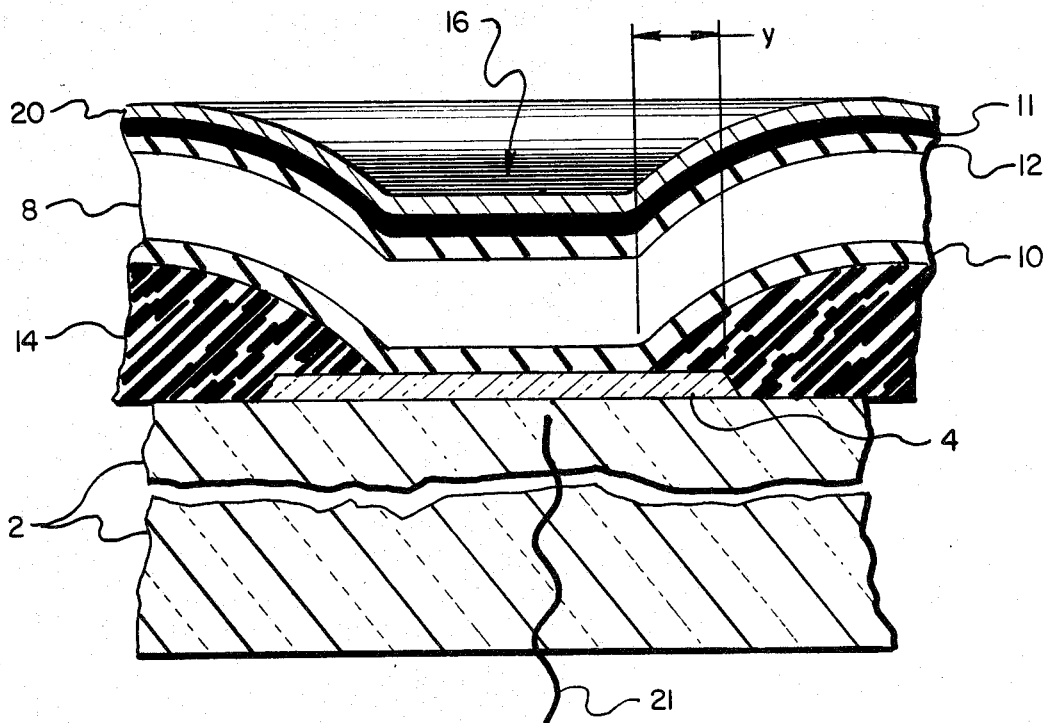
Figure 9:
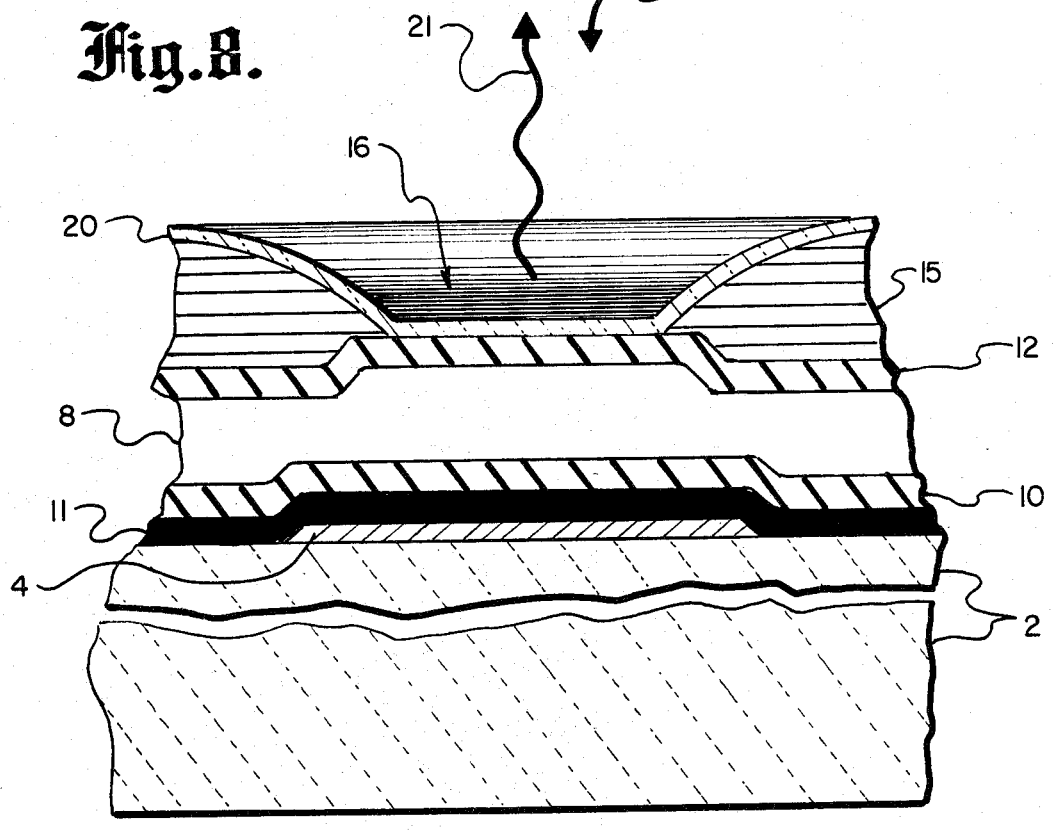
Figure 10:
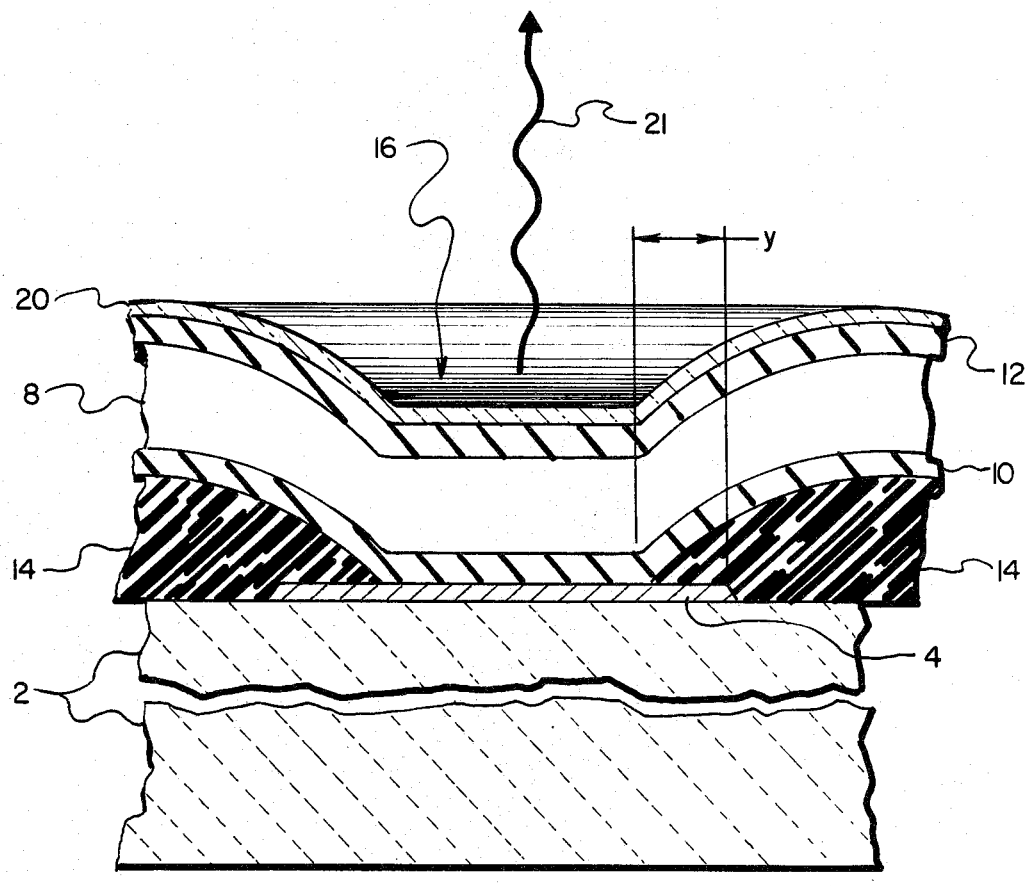

FIGS. 5*a*–5*g* shows steps a–g in the fabrication of TFEL displays; and FIGS. 6, 7, and 8 show embodiments which correspond to FIGS. 1, 2, and 3 (respectively) except that the insulating layer is positioned on the substrate rather than on the EL layer; and FIGS. 9 and 10 show embodiments which correspond to FIGS. 3 and 6 except that the light shines through a transparent backside electrode.

DESCRIPTION OF THE PREFERRED EMBODIMENT

In order to provide a bright, thin film, electroluminescent (TFEL) display it is necessary to provide a high electric field across a thin film of EL material. However, in order to provide a display with a long life, it is necessary to prevent failure of the EL material which can be caused by high electric fields. These two contradictory requirements are resolved in the present invention by spacing the backside electrode away from the EL layer except at the pixel location where the backside and frontside electrodes cross. In this pixel location, the electric fields are highest and thus provide bright luminescence. In the locations between the pixels the electric field is greatly reduced by the wider space between the electrodes. Breakdown of the EL layer at each pixel can still occur and cause the adjacent backside electrode to vaporize. However, the portion of the electrode which is spaced away from the pixel is protected and serves as an electrical bypass to continue providing electrical contact with the remaining pixels in the row. Thus, an open circuit failure is limited to a particular pixel and the remainder of the addressed line of the EL layer continues to operate.

FIG. 1 shows a partial view of a TFEL display according to the invention. The front (or viewing) side of the display is covered by glass substrate 2. Transparent electrodes 4 are deposited on the glass in parallel strips. As is known in the art, these can be indium oxide, tin oxide or mixtures of these oxides. The active, light emitting layer 6 contains an EL material such as zinc sulfide doped with manganese. In FIG. 1, active layer 6 comprises layer 8 of zinc sulfide doped with manganese and two outer layers 10, 12 of a dielectric material such as yttrium oxide or barium titanate.

An important feature of the invention is insulating layer 14 which covers the entire backside of the display except for holes 16 which are positioned above frontside electrodes 4. Insulating layer 14 must be thick enough to resist breakdown at the operating voltage of the display, and it must provide sufficient resistance to avoid leakage to adjacent electrodes. Insulating layer 14 is thick between holes 16 and tapers inwardly and downwardly into the holes. It overlaps edges 18 of underlying frontside electrode 4.

Broad backside electrodes 20 are deposited on insulating layer 14. The backside electrodes run in parallel strips at right angle to the underlying frontside electrodes. They extend into each hole 16, and (in the embodiment shown in FIG. 1) are centered on holes 16. Gaps 22 provide electrical separation between the backside electrodes.

To activate the display, a voltage is applied between the frontside and backside electrodes to provide an electric field across EL layer 6 which causes light 21 to shine out of active layer 6. The resulting electric field is proportional to the applied voltage, v, divided by the distance, x, separating the electrodes (assuming materials having the same dielectric constant). As shown in FIG. 1, the electric field between pixels is much less than it is at the pixel because $x_b$ is much larger than $x_p$. Any increase in the distance $x_b$ as compared to $x_p$ will provide a reduced electric field and some protection from breakthrough between pixels. Panels have been made using epoxy (which has a relative dielectric constant of about 4.0 and a resistivity of about $10^{15}$ ohm-cm) to form insulating layer 14. In these panels, $X_b$ was about 35 microns and $X_p$ about 1 micron. This provided over a 10 to 1 reduction of the field strength in the active layer 6 between the pixels.

The electric field produced by electrode 4 tends to concentrate at edges or discontinuities in the electrodes. The resulting high electric field can cause early failure of the adjacent EL layer. In the present invention, this problem is overcome by overlapping the edges of frontside electrode 4 with insulating layer 14. This overlap reduces the electric field in these critical areas. In FIG. 1, the overlap is shown by dimension Y. By "edges" is meant the sides, corners, or any other field-concentrating discontinuities in the electrode.

FIG. 2 shows the cross section at the center of a pixel for a second embodiment. In this embodiment, insulating layer 14 is black and is backed up by conducting black electrode 15. Black electrode 15 extends across hole 16 and provides a light absorbing surface in the pixel area which is not covered by black insulating layer 14. Black electrode 15 can be a metallic layer 20 having a thin black surface 19. For example, black surface 19 can be a semi-insulating coating such as a thin, sub-oxide layer of aluminum as described in U.S. Pat. No. 4,287,449. Black electrode 15 together with black insulating layer 14 provide a continuous light absorbing surface behind dielectric layer 12, and thereby reduces light scattering and reflection.

In the embodiment shown in FIG. 3, a continuous, light-absorbing, semi-insulating layer 11 completely covers dielectric layer 12. By semi-insulating is meant having a resistivity in the range of $10^8$ to $10^{12}$ ohm-cm. Cadmium telluride or other light absorbing material having a resistivity in this range can be used. It has been discovered that if semi-insulating layer 11 is thin (less than about 1000 Angstroms), circuit failures caused by blemishes in light emitting layer 6 can be limited to non-propagating, pin-hole, open circuit type failures that are less than about 0.001 inches in diameter. Such small failures are barely perceptible to the human eye and have only a negligible effect on image quality. Although insulating layer 13 in the FIG. 3 embodiment is not black, light is absorbed across the entire back side of the display because semi-insulating layer 11 completely covers the back side of light emitting layer 6.

FIG. 4 is a plan view looking down into hole 16 forming a pixel of the display. This view clearly shows how broad, backside electrode 20 runs normal to frontside electrode 4. It also shows how the edge of the insulating layer overlaps edge 18 of underlying frontside electrode 4. Note how broad the electrodes are with only small gaps 22 separating them to provide electrical isolation between them. This broad electrode structure provides protection against open circuiting an entire electrode by providing a more than ample conductive path in case of complete vaporization of the electrode at hole 16.

FIG. 5 illustrates in steps a to g a process for fabricating the TFEL display utilizing known lithographic and vacuum deposition techniques. Indium oxide, tin oxide, or a mixture of indium and tin oxide are deposited on glass substrate 2 to form frontside, transparent electrodes 4. A dielectric layer 10 such as yttrium oxide is deposited on substrate 2 and on electrode 4. Electroluminescent layer 8 (for example zinc sulfide doped with manganese) and second dielectric layer 12 are formed over the first dielectric layer. Second dielectric layer 12 can be yttrium oxide like layer 10.

Except for holes 16, the entire backside of the display is then coated with insulating layer 14 which is typically about 10 microns or more thick. The insulating layer can be an epoxy which tends to form a tapered edge into hole 16 as shown in FIG. 4*f* or a photoresist, or a Polyimide, or other suitable insulating material. In order to absorb scattering light, layer 14 can be black.

Finally, backside electrodes 20 are deposited in parallel strips at right angles to frontside electrodes 4. It has been discovered that burn-outs of the backside electrode can be confined to small pin holes if the electrode thickness in the pixel area is less than about 1200 Angstroms. However, this thickness can be increased as desired in locations outside the pixel area. The backside electrodes can be a metal such as aluminum, and they can cover insulating layer 14 except for gaps (22 in FIGS. 1 and 4) between them to provide electrical isolation. This provides a reliable, rugged, reproducible structure which has improved lifetime.

The embodiments shown in FIGS. 2 and 3 can be made in a sequence similar to that shown in FIG. 5 except for additional steps to add the additional light-absorbing layers. Thus, thin black surface 19 in FIG. 2 is deposited over the top surface shown in FIG. 5*f* prior to deposition of metal 20. Similarly, semi-insulating layer 11 in FIG. 3 is deposited over the top surface shown in FIG. 5*e* prior to deposition of insulating layer 13 and metal 20. Although it may be convenient to cover the entire surface with black electrode 15 (FIG. 2) or semi-insulating layer 11 (FIG. 3), the invention also encompasses covering only the pixel area (hole 16) with black, particularly if the insulating layer is black (or light absorbing).

FIGS. 6, 7, and 8 show embodiments in which insulating layer 14 is located on transparent substrate 2 and on a portion of transparent electrode 4 rather than on light emitting layer 6. These embodiments also provide the advantage of a lower electric field between pixels than at the pixel. Depending upon the properties (contact angle, index of refraction, etc.) of the particular materials used, these embodiments may provide advantages such as easier processing and better adhesion of insulating layer 14. Except for the location of insulating layer 14, FIG. 6 corresponds to the embodiment shown in FIG. 1. Similarly, FIG. 7 corresponds to the embodiment shown in FIG. 2 with a black conducting back electode 15; and FIG. 8 corresponds to the embodiment shown in FIG. 3 with light absorbing, semi-insulating layer 11.

FIGS. 9 and 10 show embodiments in which light 21 is emitted from the opposite side (previously called the backside) of the EL display panel. This is accomplished by providing a transparent electrode on the opposite side. Means can be provided on the other side to either absorb or reflect light.

For example, FIG. 9 shows backside electrode 20 made from a conducting, transparent material such as indium and tin oxides. Frontside electrode 4 can then be made of either a transparent material or of an opaque material such as aluminum. Similarly, substrate 2 can be an insulating opaque material such as a ceramic or it can have an opaque coating. FIG. 9 shows an embodiment in which a separate, semiconductive, light absorbing layer 11 is included to correspond to the embodiment shown in FIG. 3.

The FIG. 10 embodiment is representative of the embodiments shown in FIGS. 6–7 in which insulating layer 14 is positioned on the substrate, except that the backside electrode 20 is the transparent electrode and light shines from the backside of the EL panel.

The invention also encompasses an embodiment in which light shines from both the frontside and the backside of the EL panel. This is accomplished by combining the glass substrate and transparent frontside electrode of FIGS. 1–8 with the transparent backside electrode of FIGS. 9 or 10.

Numerous variations can be made without departing from the invention. Accordingly, it should be understood that the form of the invention described above is illustrative and is not intended to limit the scope of the invention.

What is claimed is:

1. An electroluminescent display comprising:
- a substrate;
- a first electrode on said substrate;
- a second electrode spaced apart from said first electrode, at least said first or said second electrode being a transparent electrode;
- a light emitting layer containing electroluminescent material between said first and second electrodes;
- an insulating layer between said first and second electrodes, said insulating layer having a hole positioned where said first and second electrodes cross each other, said second electrode extending into said hole, whereby said first and second electrodes are closest to each other at said hole.

2. The electroluminescent display as claimed in claim 1, wherein said insulating layer is positioned between said light emitting layer and said second electrode, said second electrode extending out of said hole and onto said insulating layer.

3. The electroluminescent display as claimed in claim 1, wherein said insulating layer is positioned between said light emitting layer and said substrate and extends over the edges of said first electrode.

4. The electroluminescent display as claimed in claim 1 wherein said first and second electrodes are both transparent, whereby light from said light emitting layer is emitted from both sides of said display.

5. The electroluminescent display as claimed in claim 1 wherein said first electrode and said substrate are transparent and said second electrode is opaque, whereby light from said light emitting layer is emitted through said substrate.

6. The electroluminescent display as claimed in claim 1 wherein said second electrode is transparent, whereby light from said light emitting layer is emitted through said second electrode.

7. The electroluminescent display as claimed in claim 5 wherein said second electrode comprises a black electrode.

8. The electroluminescent display as claimed in claim 5 including a light-absorbing semi-insulating layer on said light emitting layer between said light emitting layer and said second electrode.

9. The electroluminescent display as claimed in claim 8 wherein said light-absorbing semi-insulating layer is less than about 1500 Angstroms thick.

10. The electroluminescent display as claimed in claim 1 wherein the sides of said hole in said insulating layer slope inwardly and downwardly to the bottom of said hole and extend over the edges of said first electrode.

11. The electroluminescent display as claimed in claim 1 wherein said insulating layer is a black insulating layer.

12. The electroluminescent display as claimed in claim 1 wherein the portion of said second electrode which is in said hole has a thickness less than about 1000 Angstroms.

13. The electroluminescent display as claimed in claim 1 wherein said light emitting layer comprises an electroluminescent layer sandwiched between two dielectric layers.

14. An electroluminescent display panel comprising:
- a transparent substrate;
- transparent first electrodes parallel to each other on said transparent substrate;
- a first dielectric layer on said substrate and said transparent first electrode;
- an electroluminescent layer on said first dielectric layer;
- a second dielectric layer on said electroluminescent layer;
- an insulating layer covering said second dielectric layer except for holes positioned over said transparent first electrodes, the sides of said holes sloping inwardly and downwardly to the bottom of said holes and extending over the edges of said transparent first electrodes; and second electrodes parallel to each other on said second dielectric layer in said holes and extending out of said holes and onto said insulating layer, said second electrodes crossing over said first electrodes whereby pixels are formed at the location of said holes.

15. The electroluminescent display panel as claimed in claim 14 wherein said second electrodes comprise black electrodes.

16. The electroluminescent display panel as claimed in claim 14 wherein said insulating layer is a black insulating layer.

17. The electroluminescent display panel as claimed in claim 14 including a light absorbing, semi-insulating layer between said second dielectric and said insulating layer.

18. The electroluminescent display panel as claimed in claim 17 wherein said light absorbing, semi-insulating layer is less than about 1500 Angstroms thick.

19. An electroluminescent display comprising:

a transparent substrate;

transparent first electrodes parallel to each other on said transparent substrate;

an insulating layer covering said transparent substrate except for holes positioned over said transparent first electrodes, the sides of said holes sloping downward to the bottom of said holes and extending over the edges of said transparent first electrodes;

a first dielectric layer on said insulating layer and on the portion of said first electrodes that are exposed at said holes;

an electroluminescent layer on said first dielectric layer;

a second dielectric layer on said electroluminescent layer; and second electrodes parallel to each other on said second dielectric layer and extending into said holes, said second electrodes crossing over said first electrodes whereby pixels are formed at the location of said holes.

20. The electroluminescent display as claimed in claim 19 wherein said second electrode comprises a black electrode.

21. The electroluminescent display as claimed in claim 19 including a light absorbing, semi-insulating layer between said second dielectric and said insulating layer.

22. The electroluminescent display as claimed in claim 21 wherein said semi-insulating layer is less than about 1500 Angstroms.

23. The electroluminescent display as claimed in claim 19 wherein said insulating layer is a black insulating layer.

24. An electroluminescent display comprising:

a transparent substrate;

transparent first electrodes parallel to each other on said transparent substrate;

transparent second electrodes parallel to each other, crossing said first electrodes, and spaced apart from said first electrodes;

a light emitting layer containing electroluminescent material between said first and second electrodes;

an insulating layer between said first and second electrodes, said insulating layer having holes located where said first and second electrodes cross each other, said second electrodes extending into said holes, whereby light from said light emitting layer can shine out of both sides of said display.

25. An electroluminescent display comprising:

a transparent substrate;

transparent first electrodes parallel to each other on said transparent substrate;

opaque second electrodes parallel to each other, crossing said first electrodes, and spaced apart from said first electrodes;

a light emitting layer containing electroluminescent material between said first and second electrodes;

an insulating layer between said first and second electrodes, said insulating layer having holes located where said first and second electrodes cross each other, said second electrodes extending into said holes, whereby light from said light emitting layer can shine out of said display through said transparent substrate.

26. An electroluminescent display comprising:

a substrate;

first electrodes parallel to each other on said substrate;

means for preventing light from shining out said substrate side of said display;

transparent second electrodes parallel to each other, crossing said first electrodes, and spaced apart from said first electrodes;

a light emitting layer containing electroluminescent material between said first and second electrodes;

an insulating layer between said first and second electrodes, said insulating layer having holes located where said first and second electrodes cross each other, said second electrodes extending into said holes, whereby light from said light emitting layer can shine out of said display through said second electrodes.

27. The display as claimed in claim 26 wherein said means for preventing light comprises a means for absorbing light.

28. The display as claimed in claim 26 wherein said means for preventing light comprises a means for reflecting light.

* * * * *